United States Patent [19]

Koch et al.

[11] 3,976,178

[45] Aug. 24, 1976

[54] COIN RELEASE OPERATED LOCKING DEVICE

[76] Inventors: Evaristo Koch, Lehnhaldenstrasse 20, 9014 St. Gall; Kilian Schwizer, Flawilstrasse 17, 9202 Gossau, both of Switzerland

[22] Filed: Nov. 18, 1974

[21] Appl. No.: 524,679

[30] Foreign Application Priority Data

Nov. 19, 1973 Switzerland ..... 16237/73

[52] U.S. Cl. ..... 194/67

[51] Int. Cl.[2] ..... G07F 5/00

[58] Field of Search ..... 194/45–51, 194/18, 2, 1 B, 1 F, 92, 67–70, 32–44

[56] References Cited

UNITED STATES PATENTS

| | | | |
|---|---|---|---|
| 1,348,768 | 8/1920 | Williams | 194/51 |
| 2,805,747 | 9/1957 | Maurer | 194/51 |
| 3,613,855 | 10/1971 | Stackhowie | 194/51 |
| 3,664,475 | 5/1972 | Koch | 194/51 |
| 3,773,158 | 11/1973 | Wada | 194/51 |

*Primary Examiner*—Allen N. Knowles

[57] ABSTRACT

To permit selective operation of a lock, by a key, upon insertion of a coin, or a master key, a release element projects into the path of a coin insertion channel, the release element being depressed upon insertion of a coin and permitting rotation of a lock cylinder; the lock cylinder carries, in addition to the locking bolt, a lever which, upon rotation thereof, moves the coin out of the path of the release element, and to a second position in line with the further path of the coin chute, so that, upon subsequent operation of the lock cylinder, the coin will drop through the chute. To permit operation by a master key, the release element engages an internal locking tumbler which can be independently moved by a master key, so that the lock can be operated without a coin, or if the coin chute is plugged.

14 Claims, 6 Drawing Figures

COIN RELEASE OPERATED LOCKING DEVICE

Cross reference to related Patent: U.S. Pat. No. 3,664,475

The invention relates to a coin operated locking device of the kind having a locking bolt which can be moved by a key into a locking position only after the insertion of a coin. The coin is then guided to a collecting receptacle from which the coin may, for example, be retrieved after reinsertion of the key, the coin having been security for return of the key. One such device has an unlocking part, projecting into a coin receiving channel of the device which is brought into a released posititon by the inserted coin, to release the bolt and permit movement of same into the locking position. A coin retaining means is arranged to retain an inserted coin in a first position; a lever, associated with the bolt is arranged to release the retained coin only after movement of the bolt from the locking position to an open position thereof.

A locking device of this kind may be used, for example, for clothes lockers in open-air or indoor baths. A coin has to be deposited in the locker as security for return of the key. Yet, the locking device should be capable of being opened without insertion of a coin, for example, by superintending staff, with a master key. Also, it may be required that certain categories of users should be able to operate the locking device with a key without the insertion of a coin. In addition, superintending staff should be able to open the doors if coins have jammed in the coin channel, of if the coin channel has been maliciously jammed.

Subject matter of the present invention: The unlocking part cooperates with holding means of the lock which are operated by means of the key; the lever has a shoulder or a projection for the deflection of the coin from the first position so as to effect unlocking of the holding means into a second position, preparing the release of the coin.

The locking device is simple and, in addition, the locking device may be opened with a special key even without the insertion of a coin.

The invention will now be described further, by way of example only, and with reference to the accompanying drawings in which.

Figure 1:
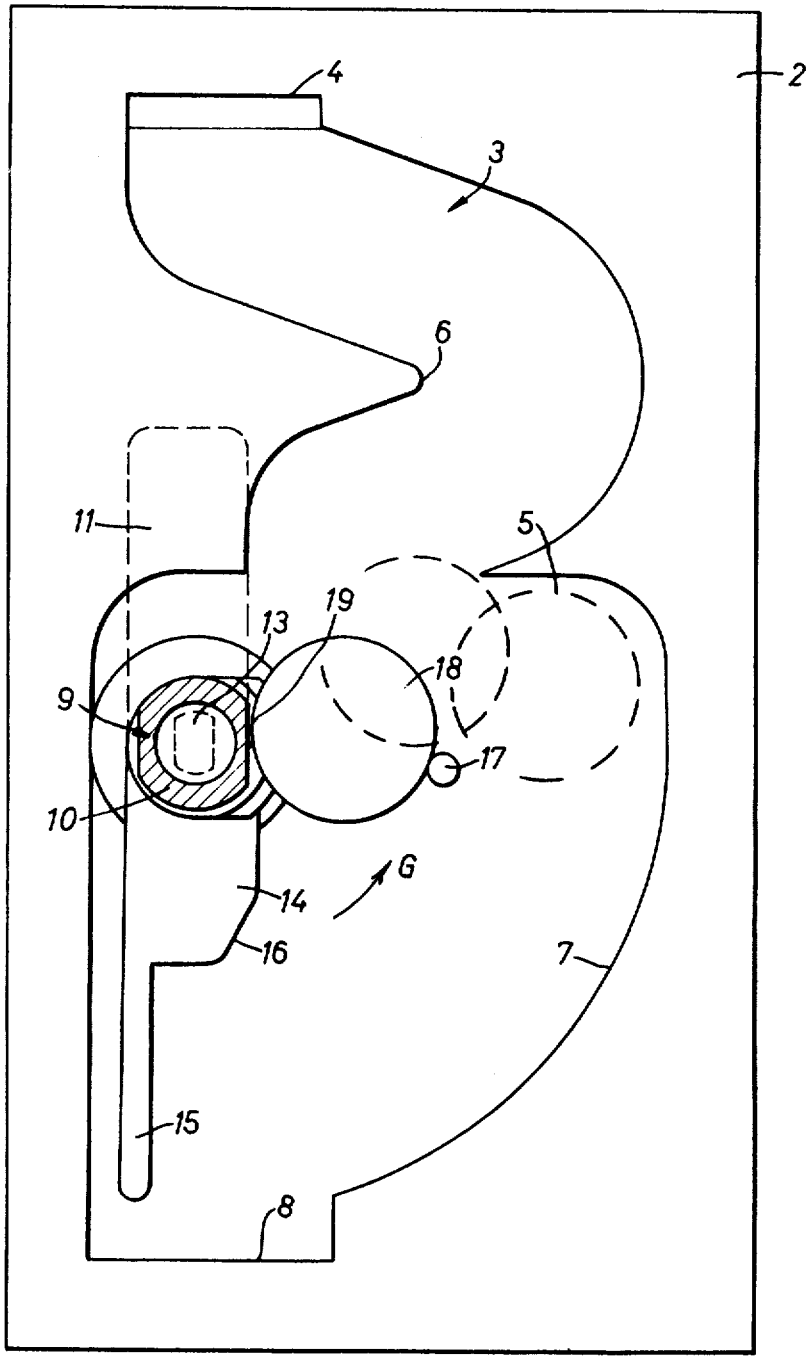
FIG. 1 is a view of a base plate of one form of a locking device according to the invention as seen from the front with a front plate removed and the bolt in the open position.
Figure 2:
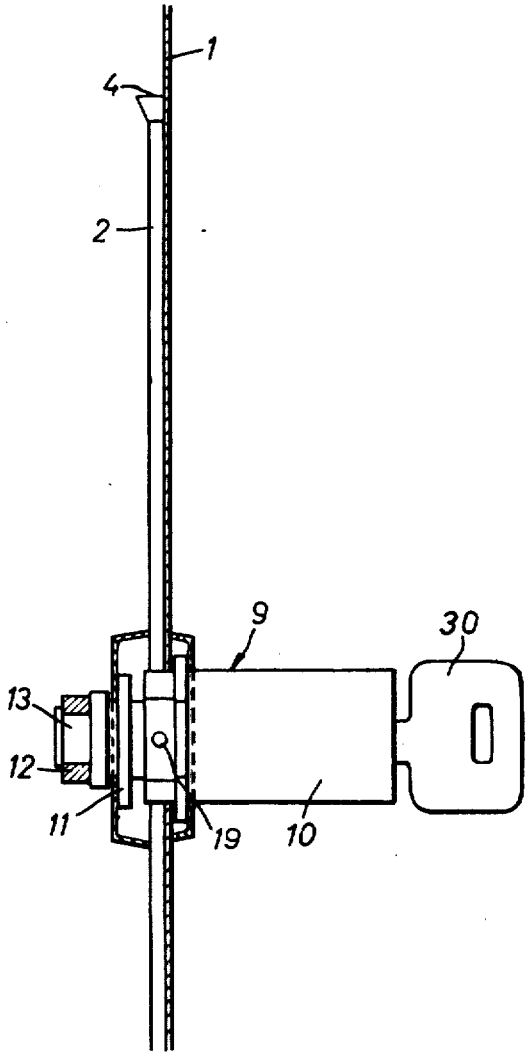
FIG. 2 is a side view of the locking device of FIG. 1.

The locking device has a front plate 1 (FIG. 2) consisting of sheet metal which is rigidly fixed in a cutout in the door of a clothes locker, left-luggage locker or the like. A fixed base plate 2 (FIG. 1) is located behind the front plate 1. A coin channel 3 if formed in base plate 2, for example, as a recessed groove in the base plate 2. This coin channel 3 is provided at a top end thereof with an insertion opening 4 accessible from the inside of the door for a coin or a token. The coin channel 3 runs arcuately and has a guide nose 6 so that a coin 18, when inserted, does not fall freely down the channel, but rather follows an arcuate path. The base plate 2 is rigidly connected to the front plate to form a unit. A safety lock 9 passes through the front plate and the base plate, and is firmly clamped in position by means of a nut 12 (FIG. 2). The safety lock 9 contains a stationary lock cylinder 10 projecting outwards and a rotor 13 rotatable by means of a key 30. The safety lock is in its construction of conventional design, and has an additional holding pin which, with the aid of the key, can be brought into an unbolted position rendering possible the rotation of the rotor. In addition, the lock 9 is designed in a manner per se, such that the key 30 can be withdrawn from the lock only in the locked position of the bolt 11 connected to the rotor. In the opening position and in intermediate positions between the opening position and the locked position, the key is secured against withdrawal from the lock 9.

Figure 3:
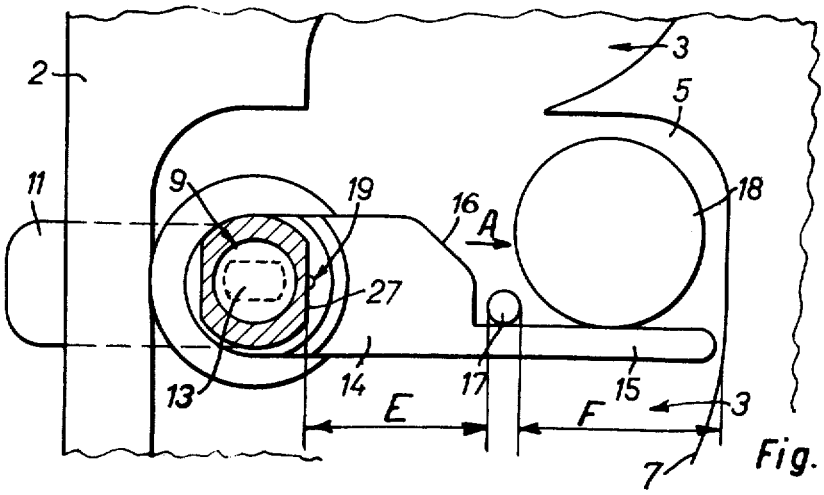
FIG. 3 is a partial view similar to FIG. 1, but with the bolt in the closed position.
Figure 4:
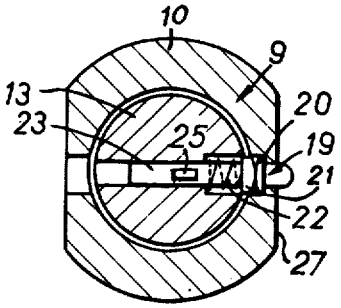
FIG. 4 is a cross section through the locking device.
Figure 5:
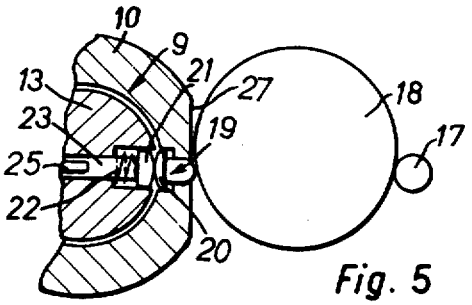
FIG. 5 is a cross section through the locking device according to FIG. 4 but with a coin inserted.
Figure 6:
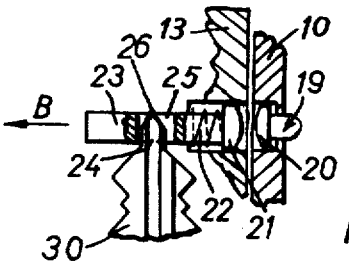
FIG. 6 is a fragmentary longitudinal section through the locking device together with an inserted key.

Additional to the usual holding device of the safety lock 9, the rotor carries a catch pin 23 (FIGS. 4–6) having a head 21 which is integrated in the safety lock. Head 21 of catch pin 23 cooperates with a short catch pin 19 projecting beyond the face 27 of the cylinder 10. In the neutral position according to FIG. 4, when the key 30 is not inserted, and there is no coin in the coin channel, a spring 22 presses the catch pin 23 into the catch position. In this catch position the head 21 of the elongated catch pin 23 projects into a bore of the cylinder, and thereby prevents rotation of the rotor 13. In the drawing, the play between the cylinder 10 and the rotor 13 is shown greatly exaggerated for the sake of clarity. In this catch position, the head 21 of the catch pin 23 presses against the head 20 of a catch pin 19, the outer end of which projects from a surface 27 of the cylinder 10 (FIG. 4). Catch pin 23 is longer than pin 19. The longer catch pin 23 contains furthermore, in its middle part, a continuous slit 25, or a groove, in which, on insertion of the key 30, a relatively narrow terminal projection 24 (FIG. 6) of the key 30 can engage. This projection 24 of the key 30 is, in addition, provided at the front with a point 26 which engages, upon pushing-in of the key 30, the slit 25 and to move pin 23 (which is initially located eccentrically) in the direction of the arrow B (FIG. 6). The longer catch pin 23 thus reaches its rotor unbolting position. Bolt 11 has a lever 14 fixed thereto. Bolt 11 and hence lever 14 is secured to the rotor 13 which is rotatable by the inserted key 30, so as to be rotatable therewith. The lever 14 is provided at a certain distance from the axis of rotation of the rotor with a shoulder 16 (FIGS. 2, 3) formed as an inclined face. The outermost part of this lever 14 is made narrower and forms a finger-like projection 15. The bolt 11 and the lever 14 may consist of a single piece or be formed as an assembly. At a distance E (FIG. 3) from the face 27 of the cylinder 10, which is slightly smaller than the diameter of a coin 18 there is located a stationary pin 17 or other projection. On the opposite side of this pin 17, spaced further radially from the lock 9, the coin channel part 5 is widened and its width F is greater than the diameter of a coin 18. In the connecting lower part of the coin channel the wall 7 runs arcuately downwards and terminates in a ejection opening. Under the ejection opening 8 there is located a receiving container or a pocket for receiving the ejected coin 18 so that it can be removed again by the user after opening the door.

Operation: When the door of a cupboard or a compartment is in the open position, the bolt 11 takes up its opening position shown in FIG. 1, in broken line. The key 30 is then secured against removal. The normally used key 30 does not have provided projection 24 and therefore the longer catch pin 23 blocks the rotor 13 against rotation. In order that the lock 9 may be moved into the locking position, it is necessary to insert a coin 18 or a token into the coin channel 3. This coin 18 then comes between the face 27 (FIGS. 3–4) of the cylinder 10, and the pin 17, which projects into the coin channel 3, and is located approximately at the same height as the center of the lock 9. Upon insertion of coin 18 the shorter catch pin 19 is pressed into the inside of the cylinder 10, its rounded head 20 presses the longer catch pin 23 (against the action of the spring 22) into the position shown in FIG. 5 in which the rounded head 21 of the longer catch pin 23 no longer engages in the bore of the cylinder 10. Thereby the longer catch pin 23 thus changes position from that shown in FIG. 4 to that shown in FIG. 5. The rotor is unbolted, and it thus can be rotated with the aid of the key 30 into the bolt-locking position.

When the key 30 is now rotated in the locking direction, the bolt 11 also comes into the locking position, and at the same time the lever 14 is moved in the direction of the arrow G (FIG. 1) and thereby comes into contact against the coin 18 (see FIG. 3) which is firmly held in the first position between the catch pin 19 and the pin 17. With increasing pivoting of the lever 14, the coin 18 is raised by the shoulder 16 and then rolls over the pin 17 in the direction of the arrow A (FIG. 3) so that the coin 18 finally takes up the second position shown in FIG. 3, in which the coin 18 lies on the finger 15. The bolt 11 is in locking position and the key 30 can now be removed. If thereafter the cupboard, locker of the like is to be opened again, the key 30 is again inserted into the lock 9 and rotated in the opening direction. This releases coin 18 from the finger 15, and coin 18 falls downwardly into the projection opening 8, and into a collection receptacle (not shown) from which, for example, it can then be removed by the user. The required movement of the coin into the second position (FIG. 3) prevents misuse. Otherwise, a deposit coin for the key could be inserted when the cupboard door opens, and the lock then turned to locking position, without closing the door. This sequence would have permitted recovery of the deposit, together with the removal of the key - a feature prevented by the system as described.

The locking device can be opened, by a master key without insertion of a coin. Such a master key would have the usual teeth to permit the lock to be unlocked, and in addition, the projection 24 with the tip 26. The projection 24 which is additionally fixed to the master key, can push the longer catch pin 23 in the direction o the arrow B (FIG. 6). Pin 23 thus is moved in a path such that head 21 reaches the unlocking position, in the same manner as by the insertion of the coin. In this way it is possible to open the lock without the insertion of a coin. This may, for example, be expedient if the coin channel has been plugged up in some way.

Instead of a rotatable bolt 11, a bolt which moves in a straight line (by means of the rotor or cam or rack, for example) could also be provided.

We claim:

1. A coin-operated locking device having a lock unit (9, 10) including a locking bolt (11) and a lock rotor (13) operating the bolt (11), which can be moved by a key (30) between locked and unlocked position a coin chute (3, 5) and a coin-retaining means (17, 27) arranged to retain an inserted coin (18) in a first position;

and a lever (14) associated with the bolt (11) and arranged to release a retained coin (18) only after movement of the bolt (11) from locking position to an opening position thereof:

wherein a release element (19, 20) is provided, comprising a first pin (19) movable by an inserted coin (18) and arranged to release rotation of the lock rotor (13), projecting into the coin-receiving chute or channel (3) of the device, movable to release position by means of an inserted coin to release the bolt (11) and permit movement of the bolt into locking position, the release element cooperating with the movable, lock rotor (13);

a second pin (23) located inside the rotor (13) is provided;

the first pin (19) contacting against the second pin (23) inside the rotor which, upon being engaged by the first pin (19), is depressed inside the rotor (13) and permits rotation of the rotor, and hence of the bolt when a coin bears against the first pin;

and the lever (14) is formed with a deflection surface (16) facing a coin in retained position for deflection of the coin from the retained position, upon movement of the bolt (11) and hence the lever (14) after release of the release element (19, 20) to a second position, preparatory to release of the coin.

2. Locking device according to claim 1, wherein the second pin (23) is formed with a key-engaging surface (25), the key-engaging surface, upon being engaged by a key having a matching pin moving surface (24, 26), moving said second pin independently of presence of a coin bearing against said frist pin and hence permitting rotation of the rotor into unlocking position upon presence of a key having said matching surface.

3. Locking device according to claim 1, wherein the coin-retaining means (17, 22) are shaped to hold a coin (18) firmly in the first position.

4. Locking device according to claim 1, wherein the deflection surface (16) on the lever (14) comprises an inclined face (16) by which a coin, held in the first position by said coin-retaining means, is moved into the second position upon closing movement of the bolt.

5. Locking device according to claim 4, wherein the lever (14) has a finger-like extension (15) connecting with the inclined face (16);

and the coin-receiving channel or chute (3) is widened opposite the locking unit (9, 10) to permit movement of the finger (15) across the channel, or chute (3), and retain a coin moved by the inclined face in the second position until subsequent movement of the bolt, and hence of the lever (14), and the finger permits release of the coin into the chute.

6. Locking device according to claim 1, wherein the coin-retaining means comprises a stationary projection or pin (17) projecting into the coin channel, or chute, and located with respect to the release element to be approximately at the same level, whereby a coin can be firmly held in the first position between the pin (17) and the release element (19, 20).

7. Locking device according to claim 6, wherein the pin (17) is positioned to be engaged by the lever (14) when the lever is moved to locking position, to serve as a stop for limiting the path of movement of the lever (14).

8. For combination with a coin-operated structure, a locking unit haveing a key-way and a coin chute or channel (3, 6);

a movable pin means (21, 23) engaging the locking unit and, upon movement, permitting movement of the locking unit to the locked position, said pin means being located in the path of said coin chute or channel and movable, upon insertion of a coin, to permit operation of the locking unit, said pin means being movable by a key (30), said pin means comprising a first pin (19) projecting into said coin channel or chute, unless engaged by a coin;

a second pin (23) in engagement with said first pin (19) and, unless depressed by a coin bearing the first pin by a spring (22) inhibiting movement of the locking unit between locked and unlocked position;

stop means (17) forming toegther with said first pin (19) a first coin retaining position;

means for moving said coin (18) from said first coin retaining position to a second coin retaining position;

and movable lever means (14) operatively connected to said locking unit defining said second coin retaining position preparatory to release of the coin after moving said lever (14) in open direction.

9. Locking device to claim 8, wherein the second pin (23) is formed with a key-engaging surface (25), the key-engaging surface, upon being engaged by a key having a matching pin moving surface (24, 26), moving said second pin independently of presence of a coin bearing against said first pin and hence permitting rotation of the rotor into unlocking position upon presence of a key having said matching surface.

10. A coin-operated locking device having a lock unit (9, 10) including a locking bolt (11) and a movable element (13) operating the bolt (11), which can be moved by a key (30) between locked and unlocked position, a coin chute (3, 5) and coin-retaining means arranged to retain an inserted coin (18) in a first position;

and a lever (14) associated with the bolt (11) and arranged to release a retained coin (18) only after movement of the bolt (11) from locking position to an opening position thereof;

wherein a movable release element (19, 20) is provided, projecting into the coin-receiving chute or channel (3) of the device, movable to release position by means of an inserted coin (18) to release the bolt (11) and permit movement of the bolt (11) into locking position, the release element cooperating with the movable key-operable lock element (13);

the lever (14) is formed with a deflection surface (16) facing a coin (18) in retained position for deflection of the coin from a first retained position, upon movement of the bolt (11) and hence the lever (14) after release of the release element (19, 20) to a second retained position, preparatory to release of the coin, after moving the lever (14) in open direction;

the deflection surface (16) on the lever (14) comprises an inclined face (16) by which a coin, held in the first position by said coin-retainging means, is moved into the second position upon closing movement of the bolt (18);

the lever (14) further has a finger-like extension (15) connecting with the inclined face (16) and forming a second coin-retained position;

and the coin-receiving channel or chute (3) is widened opposite the locking unit (9, 10) to permit movement of the coin from the first to the second position and to permit movement of the finger (15) across the channel or chute (3), and retain a coin moved by the inclined face (16) in the second position until subsequent movement of the bolt, and hence of the lever (14), and the finger permits release of the coin into the chute.

11. Locking device according to claim 10, wherein the key-operable lock element comprises a lock rotor (13);

and wherein the release element comprises a first pin (19) movable by an inserted coin (18) and arranged to release rotation of the lock rotor (13).

12. Locking device according to claim 11, wherein a second pin (23) located inside the rotor (13) is provided;

the first pin (19) contacting against the second pin (23) inside the rotor which, upon being engaged by the first pin (19), is depressed inside the rotor (13) and permits rotation of the rotor, and hence of the bolt when a coin bears against the first pin.

13. Locking device according to claim 10, wherein the second pin (23) is formed with a key-engaging surface (25), the key-engaging surface, upon being engaged by a key having a matching pin moving surface (24, 26) moving said second pin independently of presence of a coin bearing against said first pin and hence permitting rotation of the rotor into unlocking position upon presence of a key having said matching surface.

14. Locking device according to claim 10, wherein the coin-retaining means (17, 22) are shaped to hold a coin (18) firmly in the first position.

* * * * *